US009323192B2

(12) United States Patent
Nemoto

(10) Patent No.: US 9,323,192 B2
(45) Date of Patent: Apr. 26, 2016

(54) FIXING DEVICE INCLUDING SHEET MEMBER DISPOSED BETWEEN FIXING BELT AND PRESSING MEMBER AND IMAGE FORMING APPARATUS INCLUDING THE SAME

(71) Applicant: KYOCERA Document Solutions Inc., Osaka (JP)

(72) Inventor: Shinji Nemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/617,014

(22) Filed: Feb. 9, 2015

(65) Prior Publication Data

US 2015/0227096 A1 Aug. 13, 2015

(30) Foreign Application Priority Data

Feb. 10, 2014 (JP) ..... 2014-023020

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2017; G03G 15/2053; G03G 2215/2035
USPC ..... 399/122, 328, 329
See application file for complete search history.

(56) References Cited

U.S. PATENT DOCUMENTS 8,385,802 B2 2/2013 Okabe et al.
8,897,686 B2 * 11/2014 Matsumoto et al. ..... G03G 15/2053 399/122
8,909,116 B2 * 12/2014 Ohtsu ..... G03G 15/206 399/329
8,942,613 B2 * 1/2015 Ohtsu ..... G03G 15/2053 399/329

FOREIGN PATENT DOCUMENTS

JP 2010-266802 A 11/2010

* cited by examiner

*Primary Examiner* — William J Royer
(74) *Attorney, Agent, or Firm* — Studebaker & Brackett PC

(57) ABSTRACT

A fixing device includes a fixing belt, a pressuring member, a pressing member and a sheet member. The sheet member is disposed between the fixing belt and the pressing member. The sheet member includes a sliding contact part, an upstream side fixed part, a downstream side fixed part and a loose part. The sliding contact part comes into sliding contact with the inner circumference face of the fixing belt. The upstream side fixed part is fixed to the pressing member at an upstream side of the sliding contact part. The downstream side fixed part is fixed to the pressing member at a downstream side of the sliding contact part. The loose part is formed in at least one of an area between the sliding contact part and the upstream side fixed part and an area between the sliding contact part and the downstream side fixed part.

11 Claims, 10 Drawing Sheets

FIXING DEVICE INCLUDING SHEET MEMBER DISPOSED BETWEEN FIXING BELT AND PRESSING MEMBER AND IMAGE FORMING APPARATUS INCLUDING THE SAME

INCORPORATION BY REFERENCE

This application is based on and claims the benefit of priority from Japanese Patent application No. 2014-023020 filed on Feb. 10, 2014, the entire contents of which are incorporated herein by reference.

BACKGROUND

The present disclosure relates to a fixing device fixing a toner image onto a sheet and an image forming apparatus including the fixing device.

Conventionally, an electrographic image forming apparatus, such as a printer or a copying machine, forms a toner image onto a surface of a sheet, and then, heats and pressures the sheet and the toner image by a fixing device, thereby fixing the toner image onto the sheet.

Recently, because requests of energy saving and shortening of a warm-up time are increased, reduction of a heat capacity of the fixing device is actively considered. As a concrete manner actualizing the reduction of the heat capacity of the fixing device, for example, there is a "slide belt manner". The fixing device with the slide belt manner includes a fixing belt, a pressuring member configured to come into pressure contact with the fixing belt so as to form a fixing nip and a pressing member configured to press the fixing belt to a side of the pressuring member.

For example, there is a fixing device including a fixing belt, a pressuring member configured to come into pressure contact with the fixing belt so as to form a fixing nip, a pressing member configured to press the fixing belt to a side of the pressuring member and a sheet member disposed between the fixing belt and the pressing member. In the fixing device having such a configuration, a lubricant may be applied to an inner circumference face of the fixing belt.

In the fixing device having the above configuration, an upstream side end part of the sheet member in the conveying direction of sheets may be fixed to the pressing member. According to such a configuration, when a sheet jammed in the fixing nip is pulled from the upstream side in the conveying direction of sheets, the sheet member is pulled together with the fixing belt, and the sheet member is likely to be detached from between the fixing belt and the pressing member. According to this, there is a concern that abrasion of the fixing belt is encouraged, and an operating life of the fixing device shortens.

Further, in the fixing device having the above configuration, the lubricant applied to the inner circumference face of the fixing belt is likely to drip on a member (e.g. a pressing member) disposed inside of the fixing belt from the inner circumference face of the fixing belt during rotation of the fixing belt. When such a situation occurs, the amount of the lubricant held at the inner circumference face of the fixing belt decreases, and there is a concern that abrasion of the fixing belt and the sheet member is encouraged and the operating life of the fixing device shortens.

SUMMARY

In accordance with an embodiment of the present disclosure, a fixing device includes a fixing belt, a pressuring member, a pressing member and a sheet member. The fixing belt is arranged rotatably. The pressuring member is arranged rotatably and configured to come into pressure contact with the fixing belt so as to form a fixing nip. The pressing member is disposed inside of the fixing belt and configured to press the fixing belt to a side of the pressuring member. The sheet member is disposed between the fixing belt and the pressing member. The sheet member includes a sliding contact part, an upstream side fixed part, a downstream side fixed part and a loose part. The sliding contact part is configured to come into sliding contact with the inner circumference face of the fixing belt. The upstream side fixed part is fixed to the pressing member at an upstream side of the sliding contact part in a conveying direction of a sheet. The downstream side fixed part is fixed to the pressing member at a downstream side of the sliding contact part in the conveying direction of the sheet. The loose part is formed in at least one of an area between the sliding contact part and the upstream side fixed part and an area between the sliding contact part and the downstream side fixed part.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
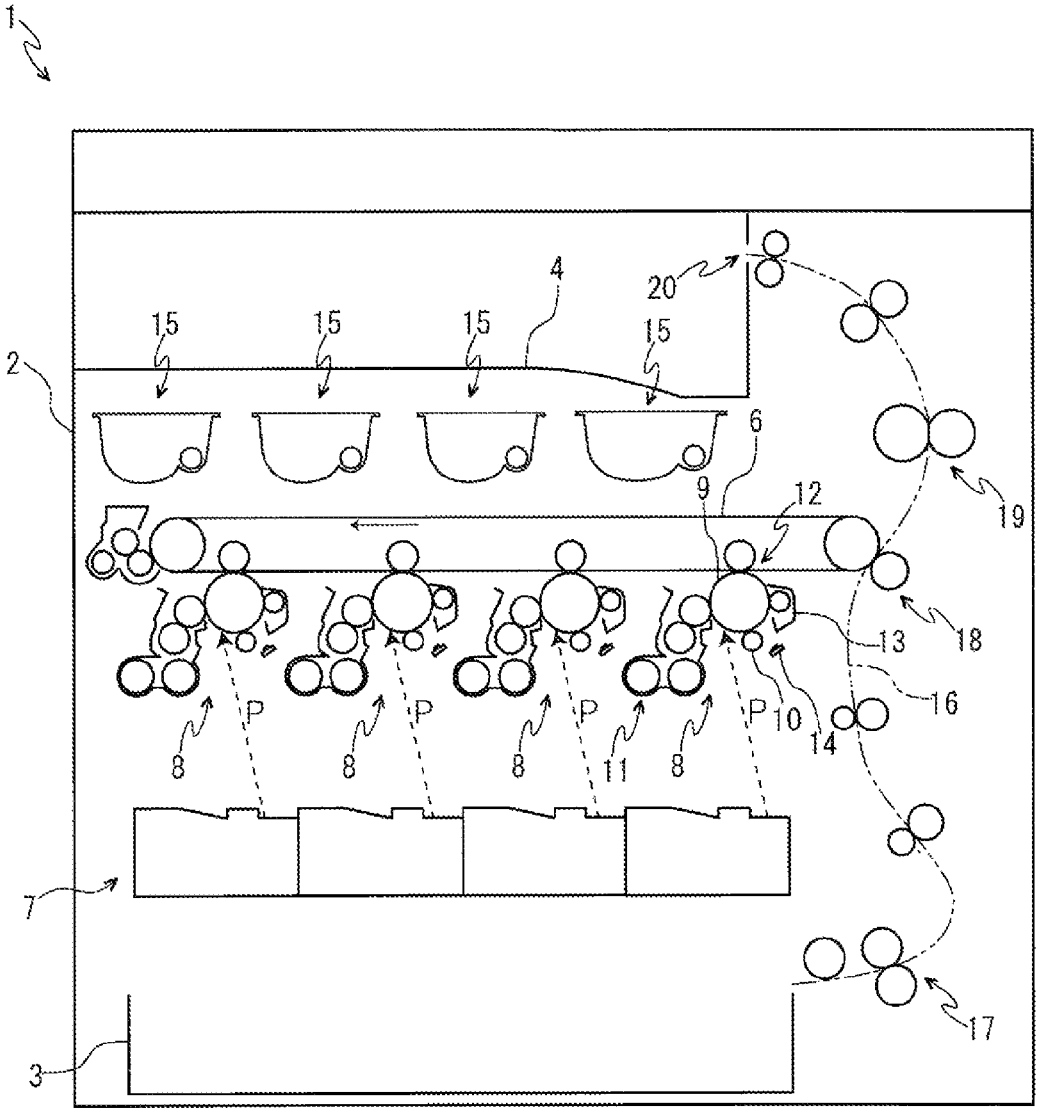
FIG. 1 is a schematic diagram showing a color printer according to a first embodiment of the present disclosure.

First, with reference to FIG. 1, the entire structure of a color printer 1 (an image forming apparatus) will be described.

The color printer 1 includes a box-shaped printer main body 2. In a lower part of the printer main body 2, a sheet feeding cartridge 3 storing sheets (not shown) is provided and, on an upper part of the printer main body 2, a sheet ejecting tray 4 is provided.

In a middle part of the printer main body 2, an intermediate transferring belt 6 is bridged over a plurality of rollers and, below the intermediate transferring belt 6, an exposure device 7 consisting of a laser scanning unit (LSU) is arranged. Near the intermediate transferring belt 6, four image forming units 8 are provided for respective colors (for example, four colors of magenta, cyan, yellow and black) of toners along a lower part of the intermediate transferring belt 6. Hereinafter, one of the four image forming units 8 will be described. In each image forming unit 8, a photosensitive drum 9 is rotatably provided. Around the photosensitive drum 9, a charger 10, a development device 11, a first transferring unit 12, a cleaning device 13 and a static eliminator 14 are arranged in order of a first transferring process. Above the development device 11, four toner containers 15 corresponding to the image forming units 8 are provided for different colors (for example, four colors of magenta, cyan, yellow and black) of toners, respectively.

On one side (the right side in the figure) in the printer main body 2, a sheet conveying path 16 is provided. At an upper stream end of the conveying path 16, a sheet feeder 17 is provided. At an intermediate stream part of the conveying path 16, a second transferring unit 18 is provided at one end (the right end in the figure) of the intermediate transferring belt 6. At a lower stream part of the conveying path 16, a fixing device 19 is provided. At a lower stream end of the conveying path 16, a sheet ejecting port 20 is provided.

Next, the operation of forming an image by the color printer 1 having such a configuration will be described. When the power is supplied to the color printer 1, various parameters are initialized and initial determination, such as temperature determination of the fixing device 19, is carried out. Subsequently, when image data is inputted and a printing start is directed from a computer or the like connected with the color printer 1, the image forming operation is carried out as follows.

First, the surface of the photosensitive drum 9 is electrically charged by the charger 10. Then, the surface of the photosensitive drum 9 is irradiated with a laser (refer to an arrow P) by the exposure device 7, thereby forming an electrostatic latent image on the surface of the photosensitive drum 9. The electrostatic latent image is then developed to a toner image having a correspondent color by the developing device 11 with a toner supplied from the toner container 15. The toner image is first-transferred onto the surface of the intermediate transferring belt 6 in the first transferring unit 12. The above-mentioned operation is repeated in order by the image forming units 8, thereby forming the toner image having full color on the intermediate transferring belt 6. Toner and electric charge remained on the photosensitive drum 9 are eliminated by the cleaning device 13 and static eliminator 14.

On the other hand, a sheet fed from the sheet feeding cartridge 3 or a manual bypass tray (not shown) by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a lower stream side on the conveying path 16 to enter the fixing device 19, and then, the toner image is fixed on the sheet in the fixing device 19. The sheet with the fixed toner image is ejected from the sheet ejecting port 20 on the sheet ejecting tray 4.

Next, the fixing device 19 will be described.

Figure 2:
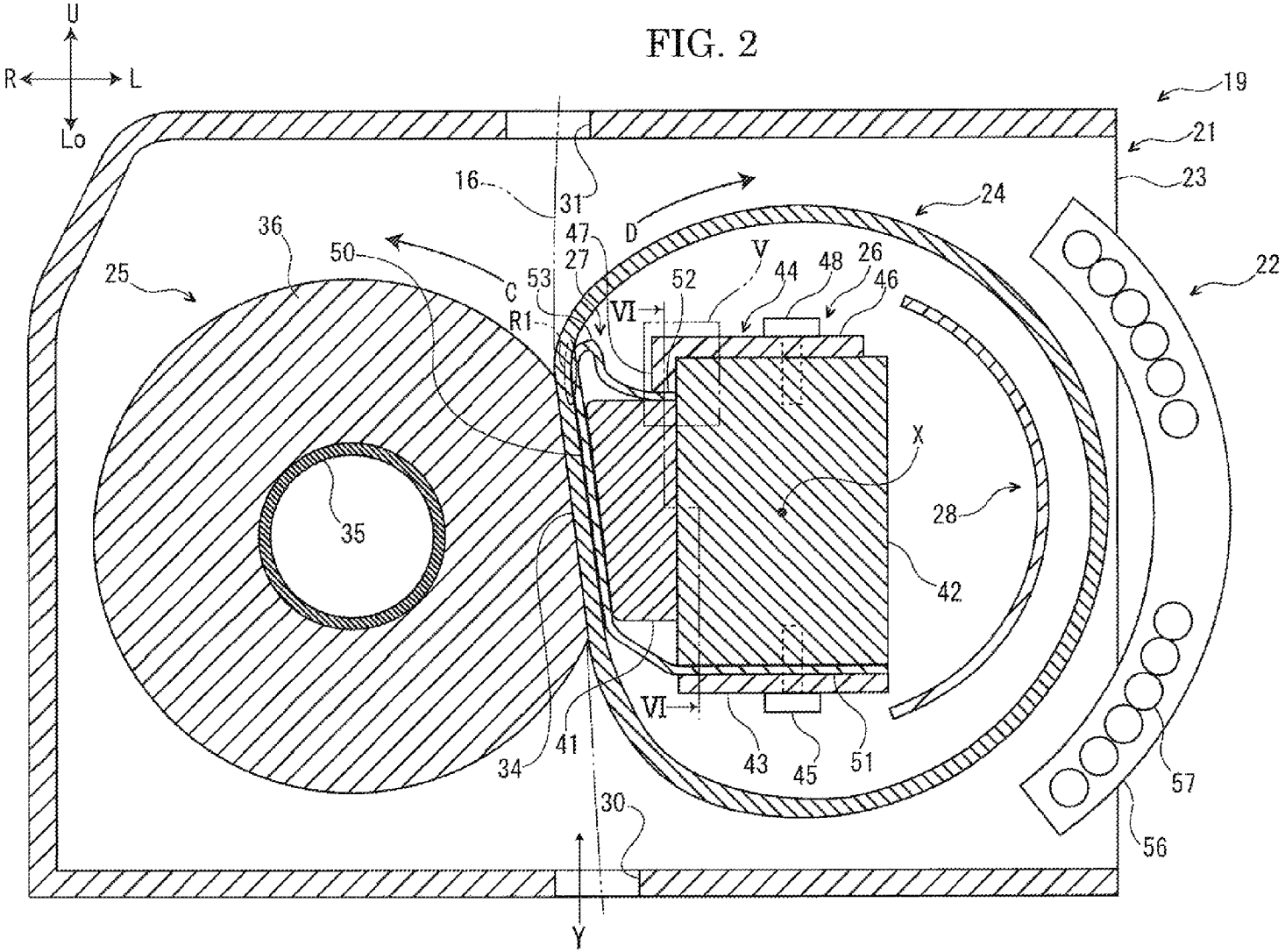
FIG. 2 is a sectional view showing a situation where a fixing belt and a pressuring roller are rotated normally, in a fixing device of the color printer according to the first embodiment of the present disclosure.

Arrows Fr, Rr, L, R, U and Lo optionally assigned to each figure subsequent to FIG. 2 indicate a front side, a rear side, a left side, a right side, an upper side and a lower side of the fixing device 19, respectively. FIG. 2 is a sectional view seen from the rear side, and therefore a left and right relationship of FIG. 2 and an actual left and right relationship are reversed. That is, the right side in FIG. 2 is the left side of the fixing device 19, and the left side in FIG. 2 is the right side of the fixing device 19. An arrow Y in FIG. 2 indicates the conveying direction of sheets.

As shown in FIG. 2, the fixing device 19 is provided with a fixing unit 21 and an IH unit 22 provided on the left side of the fixing unit 21.

First, the fixing unit 21 will be described. The fixing unit 21 is attachable and detachable to and from the printer main body 2 (see FIG. 1).

Figure 3:
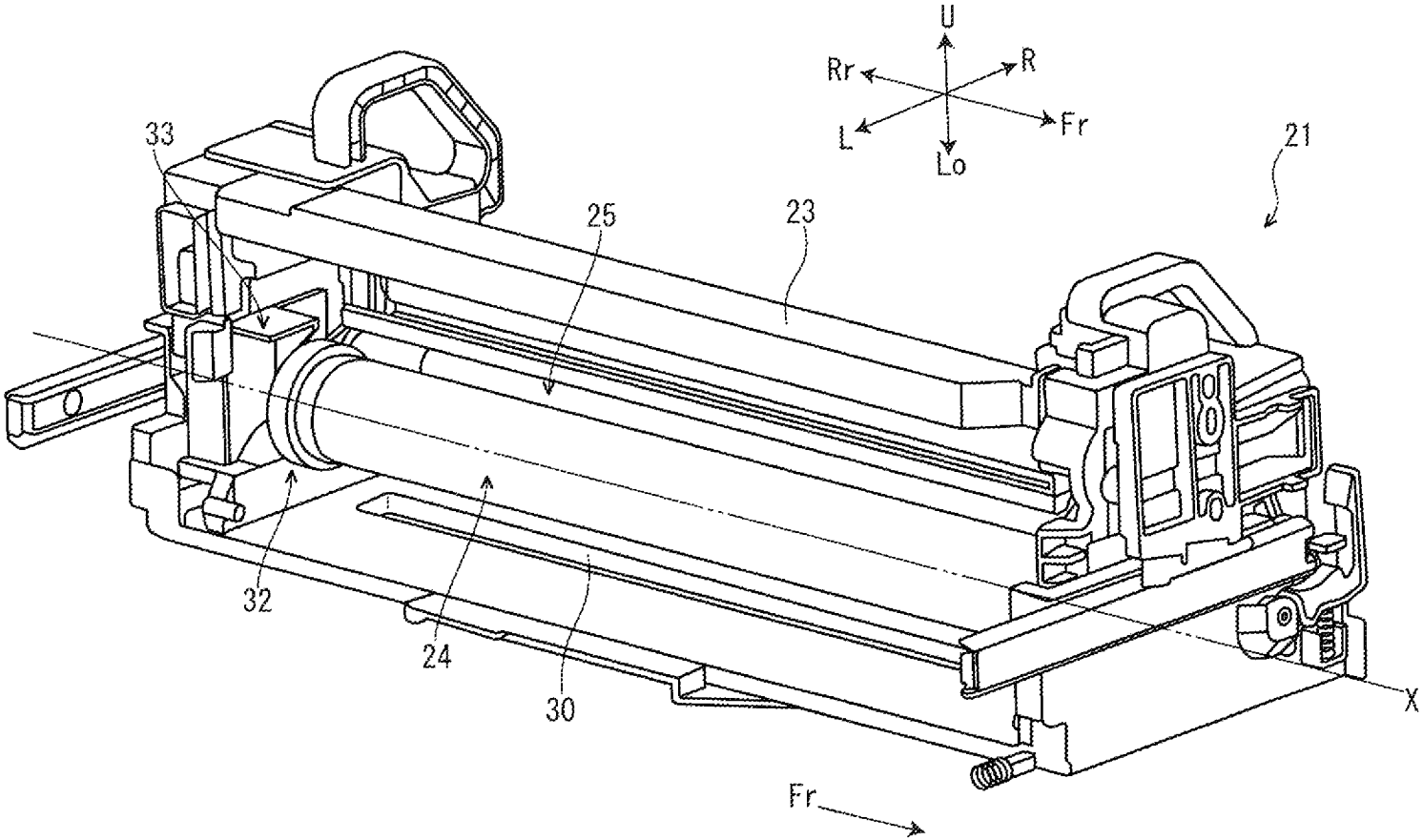
FIG. 3 is a perspective view showing a fixing unit, in the fixing device of the color printer according to the first embodiment of the present disclosure.

As shown in FIGS. 2 and 3, the fixing unit 21 is provided with a fixing frame 23, a fixing belt 24 housed in a left side part of the fixing frame 23, a pressuring roller 25 (pressuring member) housed in a right side part of the fixing frame 23, a pressing member 26 disposed inside of the fixing belt 24, a sheet member 27 disposed inside of the fixing belt 24 and provided between the fixing belt 24 and the pressing member 26, and a guiding member 28 disposed inside of the fixing belt 24 and provided on the left side of the pressing member 26.

The fixing frame 23 is formed in a box shape whose left side is opened. At a lower end part of the fixing frame 23, a guide opening 30 through which sheets are guided into the fixing frame 23 is formed. At an upper end part of the fixing frame 23, a guide opening 31 through which sheets are guided from the fixing frame 23 is formed.

The fixing belt 24 is a flexible endless belt and is formed in a nearly cylindrical shape elongated in the forward and backward directions. The fixing belt 24 is arranged rotatably around a rotation axis X extending in the forward and backward directions. That is, in the present embodiment, the forward and backward directions are a direction of a rotation axis of the fixing belt 24.

The fixing belt 24 is composed of, for example, a base material layer, an elastic layer provided around this base material layer and a release layer covering this elastic layer. The base material layer of the fixing belt 24 is formed by applying plating processing or rolling processing to metal, such as nickel or copper. The elastic layer of the fixing belt 24 is made of, for example, a silicone rubber. The release layer of the fixing belt 24 is made of, for example, fluorine-based resin, such as PFA. In addition, each figure shows the respective layers (the base material layer, the elastic layer and the release layer) of the fixing belt 24 without distinguishing the respective layers in particular.

Figure 4:
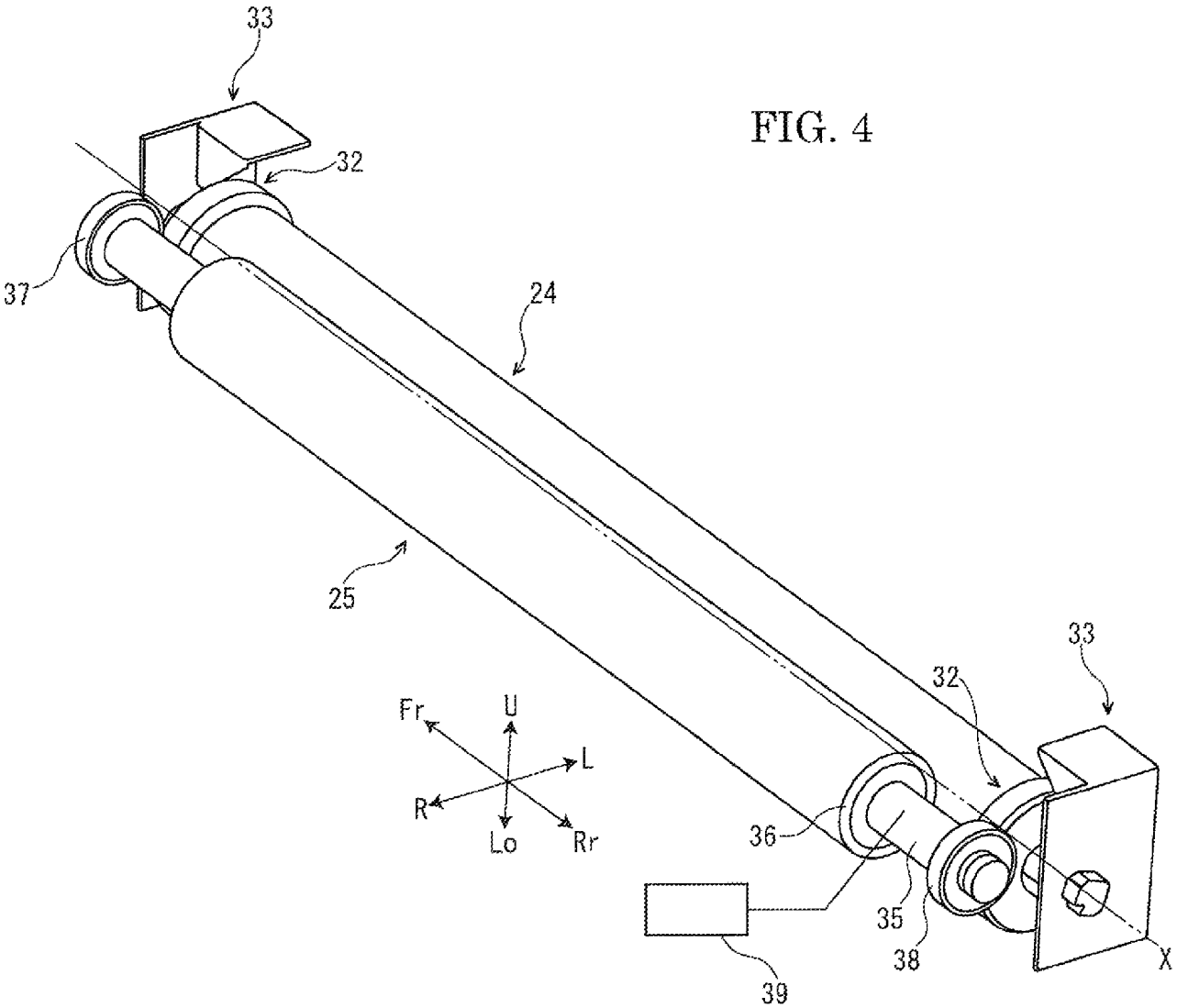
FIG. 4 is a perspective view showing an inside of the fixing unit, in the fixing device of the color printer according to the first embodiment of the present disclosure.

As shown in FIG. 4, at front and rear end parts of the fixing belt 24, flange member 32 are attached. Outside the forward and backward directions of the respective flange members 32, fixing members 33 are provided. According to this configuration, meandering of the fixing belt 24 (movement in the forward and backward directions) is restricted.

The pressuring roller 25 (see FIG. 2 and other figures) is formed in a cylindrical shape elongated in the forward and backward directions. The pressuring roller 25 comes into pressure contact with the fixing belt 24 so as to form, between the fixing belt 24 and pressuring roller 25, a fixing nip 34 along the conveying path 16 of sheets. Further, in such a configuration, when a sheet passes through the fixing nip 34, a toner image on the sheet is heated and pressured, thereby fixing the toner image onto the sheet.

The pressuring roller 25 is composed of, for example, a cylindrical core material 35, an elastic layer 36 provided around the core material 35 and a release layer (not shown) covering this elastic layer 36. The core material 35 of the pressuring roller 25 is made of, for example, metal, such as stainless steel or aluminum. The elastic layer 36 of the pressuring roller 25 is made of, for example, a silicone rubber or a silicone sponge. The release layer of the pressuring roller 25 is made of, for example, fluorine-based resin, such as PFA.

As shown in FIG. 4, at a front end part of the core material 35 of the pressuring roller 25, a front-side bearing 37 is attached. At a rear end part of the core material 35 of the pressuring roller 25, a rear-side bearing 38 is attached. The front-side bearing 37 and the rear-side bearing 38 are attached to the front and rear end parts of the fixing frame 23 (not shown in FIG. 4). Thus, the pressuring roller 25 is rotatably supported by the fixing frame 23. The core material 35 of the pressuring roller 25 is connected to a drive source 39 via a drive gear (not shown). The drive source 39 is composed of a motor or the like which can rotate normally and reversely.

As shown in FIG. 2, the pressing member 26 is provided with a pressing body 41, a supporting body 42 provided at the left side of the pressing body 41 (at the opposite side of the pressuring roller 25), an upstream side attachment plate 43 provided at a lower side of the supporting body 42 (the upstream side in the conveying direction of sheets) and a downstream side attachment plate 44 provided at an upper side of the supporting body 42 (the downstream side in the conveying direction of sheets).

The pressing body 41 has a nearly trapezoidal cross section, and extends in the forward and backward directions. The pressing body 41 presses the fixing belt 24 to the right side (the side of the pressuring roller 25) via the sheet member 27. A right face (outer face) of the pressing body 41 is linearly inclined to the right side (the side of the pressuring roller 25) toward the upper side (the downstream side in the conveying direction of sheets).

The supporting body 42 has a rectangular cross section, and extends in the forward and backward directions. To the right face (outer face) of the supporting body 42, the left face (inner face) of the pressing body 41 is fixed. Thus, the pressing body 41 is supported from the inside by the supporting body 42.

The upstream side attachment plate 43 is composed of a flat sheet metal. The upstream side attachment plate 43 extends in a horizontal direction. The upstream side attachment plate 43 is fixed to the lower face (an upstream side face in the conveying direction of sheets) of the supporting body 42 by a plurality of upstream side screws 45 arranged at intervals in the forward and backward directions.

The downstream side attachment plate 44 is composed of an L-shaped sheet metal. The downstream side attachment plate 44 is provided with a joined part 46 extending in the horizontal direction, and a bent part 47 bent from the right end part (outer end part) of the joined part 46 to the lower side (the upstream side in the conveying direction of sheets) and extending in a vertical direction. The joined part 46 is joined to an upper face (a downstream side face in the conveying direction of sheets) of the supporting body 42. The joined part 46 is fixed to the upper face (a downstream side face in the conveying direction of sheets) of the supporting body 42 by a plurality of downstream side screws 48 arranged at intervals in the forward and backward directions. The left face (inner face) of the bent part 47 comes into contact with the right face (outer face) of the supporting body 42.

As shown in FIG. 2 and other figures, the sheet member 27 is provided with a sliding contact part 50, an upstream side fixed part 51 formed below (at the upstream side in the conveying direction of sheets) the sliding contact part 50, and a downstream side fixed part 52 formed above (at the downstream side in the conveying direction of sheets) the sliding contact part 50.

A corresponding portion to the fixing nip 34 of a right face (outer face) of the sliding contact part 50 comes into sliding contact with an inner circumference face of the fixing belt 24. A left face (inner face) of the sliding contact part 50 comes into contact with the right face (outer face) of the pressing body 41 of the pressing member 26.

The upstream side fixed part 51 is sandwiched between the lower face (the upstream side face in the conveying direction of sheets) of the supporting body 42 and the upper face (a downstream side face in the conveying direction of sheets) of the upstream side attachment plate 43. The upstream side fixed part 51 is jointed with the upstream side attachment plate 43 by a plurality of above-mentioned upstream side screws 45, and is attached to the lower face (the upstream side face in the conveying direction of sheets) of the supporting body 42. According to the above configuration, below (at the upstream side in the conveying direction of sheets) the sliding contact part 50, the upstream side fixed part 51 is fixed to the pressing member 26.

Figure 5:
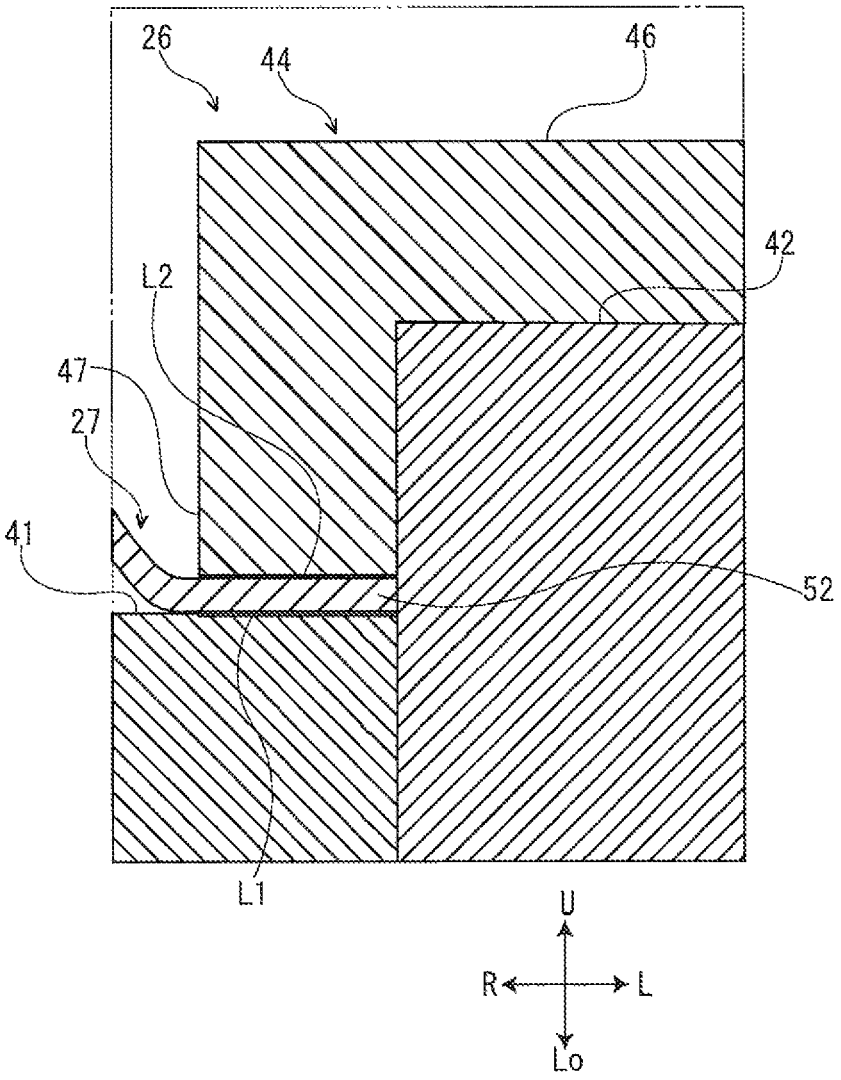
FIG. 5 is an enlarged view showing a part V of FIG. 2.

As shown in FIG. 5 and other figures, the downstream side fixed part 52 is sandwiched between the upper face (a downstream side face in the conveying direction of sheets) of the pressing body 41 of the pressing member 26 and a lower edge part (an upstream side edge part in the conveying direction of sheets) of the bent part 47 of the downstream side attachment plate 44. In the upper face of the pressing body 41, a roughening treatment (processing of forming multiple fine convexities and concavities) is applied to a portion (see a bold line L1) which contacts the downstream side fixed part 52. At the lower edge part of the bent part 47, the roughening treatment (processing of forming multiple fine convexities and concavities) is applied to a portion (see a bold line L2) which contacts the downstream side fixed part 52. According to the above configuration, above (at the downstream side in the conveying direction of sheets) the sliding contact part 50, the downstream side fixed part 52 is fixed to the pressing member 26.

Figure 6:
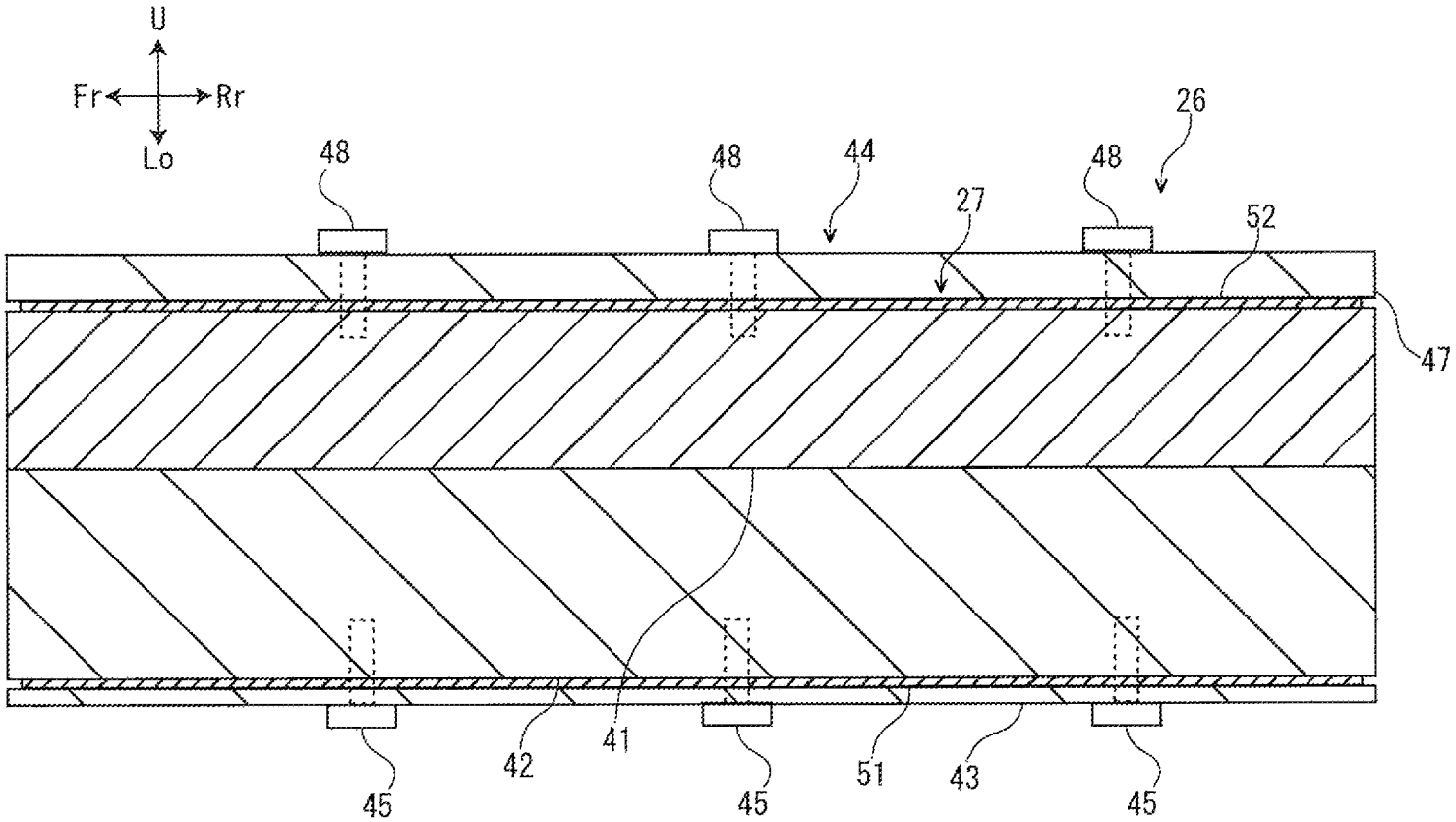
FIG. 6 is a sectional view taken along a line VI-VI of FIG. 2.

As shown in FIG. 6 and other figures, the lengths of the supporting body 42 and the upstream side attachment plate 43 in the forward and backward directions (the direction of the rotation axis of the fixing belt 24) are longer than the length of the upstream side fixed part 51 in the forward and backward directions. The lengths of the pressing body 41 and the bent part 47 of the downstream side attachment plate 44 in the forward and backward direction are longer than the length of the downstream side fixed part 52 in the forward and backward directions.

As shown in FIG. 2, a loose part 53 is formed in the sheet member 27. As described later, according to a rotation direction of the fixing belt 24 and the pressuring roller 25, the loose part 53 is formed in one of an area between the sliding contact part 50 and the upstream side fixed part 51 and an area between the sliding contact part 50 and the downstream side fixed part 52. FIG. 2 shows a state where the loose part 53 is formed in an area between the sliding contact part 50 and the downstream side fixed part 52. The loose part 53 partially contacts the inner circumference face of the fixing belt 24.

The sheet member 27 is made of, for example, glass fibers and has flexibility. To the sheet member 27, a coating of fluorine-based resin, such as PTFE, is applied.

Figure 7:
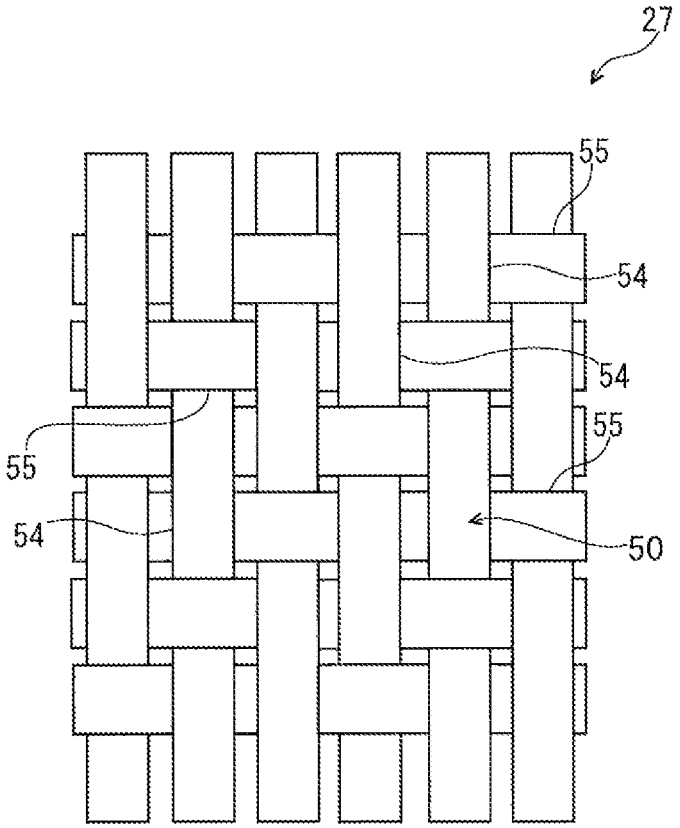
FIG. 7 is a side view showing a part of a sheet member, in the fixing device of the color printer according to the first embodiment of the present disclosure.

As shown in FIG. 7, the sheet member 27 is formed by so-called twill weaving, and is formed by weaving warps 54 and woofs 55 at different proportions. In the present embodiment, the two woofs 55 are woven while one warp 54 is woven. According to this, at a face of the fixing belt 24 side of the sliding contact part 50 (a face shown at the front side in FIG. 7), a total surface area of the warps 54 is larger than the total surface area of the woofs 55. By contrast with this, at a face of the pressing body 41 side of the sliding contact part 50 (a face hidden in the depth side in FIG. 7), the total surface area of the woofs 55 is larger than a total surface area of the warps 54. The sheet member 27 is disposed such that, at the sliding contact part 50, the warps 54 extend along the upper and lower directions (the conveying direction of sheets) and, at the sliding contact part 50, the woofs 55 extend along the forward and backward directions (a direction crossing the conveying direction of sheets).

The guiding member 28 is made of, for example, a magnetic body. As shown in FIG. 2 and other figures, the guiding member 28 is curved in an arc shape to the left side. The guiding member 28 is disposed along a left side portion of the inner circumference face of the fixing belt 24, and guides (stretches) the fixing belt 24 from the inside. The guiding member 28 is supported by, for example, the supporting body 42 of the pressing member 26.

Next, the IH unit 22 will be described. The IH unit 22 is fixed to the printer main body 2 (see FIG. 1). As shown in FIG. 2, the IH unit 22 is provided with a case member 56 and an IH coil 57 housed in the case member 56 and arranged in an arc shape along the outer circumference of the fixing belt 24.

In the fixing device 19 having the above-mentioned configuration, when a toner image is fixed to a sheet, the drive source 39 rotates the pressuring roller 25 normally (see an arrow C in FIG. 2). When the pressuring roller 25 is rotated normally as described above, the fixing belt 24 coming into pressure contact with the pressuring roller 25 is also rotated normally (see an arrow D in FIG. 2). According to this, the fixing belt 24 slides against the sliding contact part 50 of the sheet member 27.

Further, when a toner image is fixed to a sheet, an alternating-current power source (not shown) applies an alternating-current voltage to the IH coil 57. According to this, the IH coil 57 generates a magnetic field, this magnetic field acts on the fixing belt 24 to generate an eddy current, and then, the fixing belt 24 generates heat. That is, the IH coil 57 heats the fixing belt 24. Moreover, the magnetic field generated by the IH coil 57 causes heat generation of the guiding member 28, and then, the guiding member 28 heats the fixing belt 24. In such a situation, when a sheet passes through the fixing nip 34, the sheet and a toner image are heated and pressured, thereby fixing the toner image onto the sheet.

By the way, when the fixing belt 24 slides against the sliding contact part 50 of the sheet member 27, if a friction between the fixing belt 24 and the sliding contact part 50 is great, the sliding contact part 50 is rapidly worn away. According to this, there is a concern that the sliding contact part 50 is broken earlier, abrasion of the fixing belt 24 is encouraged and thereby the fixing belt 24 is broken. Hence, to prolong the operating life of the fixing device 19, it is important to reduce the friction between the fixing belt 24 and the sliding contact part 50.

Hence, in the present embodiment, a lubricant is applied to the inner circumference face of the fixing belt 24. This lubricant is made of, for example, fluorine grease, silicon grease or silicon oil. This lubricant normally adheres to the inner circumference face of the fixing belt 24, and is supplied between the fixing belt 24 and the sliding contact part 50 with the rotation of the fixing belt 24.

However, when the lubricant is semisolid or liquid, the lubricant is likely to drip from the inner circumference face of the fixing belt 24 during the rotation of the fixing belt 24. When the lubricant drips on a member which contacts the fixing belt 24, the lubricant adheres again to the fixing belt 24, so that it is possible to supply again the lubricant between the fixing belt 24 and the sliding contact part 50. However, when the lubricant drips on a member (e.g. the pressing member 26) which does not contact the fixing belt 24, the lubricant cannot be supplied again between the fixing belt 24 and the sliding contact part 50, and there is a concern that abrasion of the fixing belt 24 or the sliding contact part 50 is encouraged and therefore the operating life of the fixing device 19 shortens.

However, in the present embodiment, when the drive source 39 rotates the fixing belt 24 and the pressuring roller 25 normally, the sheet member 27 is pulled to the upper side (the downstream side in the conveying direction of sheets) by the fixing belt 24, so that the loose part 53 is formed in the area between the sliding contact part 50 and the downstream side fixed part 52 (see FIG. 2). Further, part of the lubricant applied to the inner circumference face of the fixing belt 24 is held by this loose part 53 (see a portion R1 in FIG. 2). According to this, it is possible to prevent the lubricant from dripping from the inner circumference face of the fixing belt 24 on the member which does not contact the fixing belt 24 during the rotation of the fixing belt 24. Accordingly, it is possible to increase the amount of lubricant held in the inner circumference face of the fixing belt 24, prevent the fixing belt 24 and the sliding contact part 50 from being worn away and prolong the operating life of the fixing device 19.

Further, by preventing the lubricant from dripping from the inner circumference face of the fixing belt 24, it is possible to sufficiently prevent the fixing belt 24 and the sliding contact part 50 from being worn away by using a relatively small amount of lubricant. According to this, it is possible to reduce running cost of the fixing device 19.

Further, it is important to make a position of the sheet member 27 stable to prevent the fixing belt 24 from being worn away when the fixing belt 24 is slid against the sliding contact part 50 as described above. However, the sheet member 27 has flexibility as described above, and therefore is less resilient and unlikely to take a stable position.

Hence, in the present embodiment, the upstream side fixed part 51 and the downstream side fixed part 52 are formed in the sheet member 27, and, below (at the upstream side in the conveying direction of sheets) and above (at the downstream side in the conveying direction of sheets) the sliding contact part 50, the sheet member 27 is fixed to the pressing member 26. According to this, it is possible to make the position of the sheet member 27 stable, and prevent the sliding contact part 50 from detaching from between the fixing belt 24 and the pressing body 41. According to this, it is possible to prevent the fixing belt 24 from being worn away and further prolong the operating life of the fixing device 19.

Further, between the lower face (the upstream side face in the conveying direction of sheets) of the supporting body 42 and the upper face (the downstream side face in the conveying direction of sheets) of the upstream side attachment plate 43, the upstream side fixed part 51 of the sheet member 27 is sandwiched. By applying such a configuration, it is possible to prevent the configuration of the upstream side attachment plate 43 from being complicated, and sandwich the upstream side fixed part 51 between wider areas of the supporting body 42 and the upstream side attachment plate 43.

Further, the lengths of the supporting body 42 and the upstream side attachment plate 43 in the forward and backward directions (the direction of the rotation axis of the fixing belt 24) are longer than the length of the upstream side fixed part 51 in the forward and backward directions. Consequently, it is possible to prevent the sheet member 27 from being wrinkled when the sheet member 27 is pulled to the upper side (the downstream side in the conveying direction of sheets) with the rotation of the fixing belt 24. According to this, it is possible to prevent the fixing belt 24 and the sliding contact part 50 from being locally worn away.

Further, between the upper face (the downstream side face in the conveying direction of sheets) of the pressing body 41 and the lower edge part (the upstream side edge part in the conveying direction of sheets) of the bent part 47, the downstream side fixed part 52 is sandwiched. By applying such a configuration, when the loose part 53 is formed in the area between the sliding contact part 50 and the downstream side fixed part 52, it is possible to form the loose part 53 at a position close to the sliding contact part 50 (see FIG. 2). According to this, the lubricant can be more easily held at the loose part 53.

Further, to the upper face (the downstream side face in the conveying direction of sheets) of the pressing body 41 and the lower edge part (the upstream side edge part in the conveying direction of sheets) of the bent part 47, the roughening treatment is applied to a portion which contacts the downstream side fixed part 52. By applying such a configuration, it is possible to enhance the strength to fix the downstream side fixed part 52.

Further, the lengths of the pressing body 41 and the bent part 47 in the forward and backward directions (the direction of the rotation axis of the fixing belt 24) are longer than the length of the downstream side fixed part 52 in the forward and backward directions. Consequently, when a sheet is jammed at the fixing nip 34, and the fixing belt 24 and the sheet member 27 are pulled to the lower side to pull the sheet from the lower side (the upstream side in the conveying direction of sheets), the sheet member 27 is hardly wrinkled. Consequently, it is possible to prevent the fixing belt 24 and the sliding contact part 50 from being locally worn away.

Further, the sheet member 27 is formed by weaving at different proportions the warps 54 along the upper and lower directions (the conveying direction of sheets) at the sliding contact part 50 and the woofs 55 along the forward and backward directions (a direction crossing the conveying direction of sheets) at the sliding contact part 50. Furthermore, at the face of the fixing belt 24 side of the sliding contact part 50, the total surface area of the warps 54 is larger than the total surface area of the woofs 55. By applying such a configuration, it is possible to encourage a flow of a lubricant along the upper and lower directions (the conveying direction of sheets), and smoothly supply the lubricant between the fixing belt 24 and the sliding contact part 50.

Figure 8:
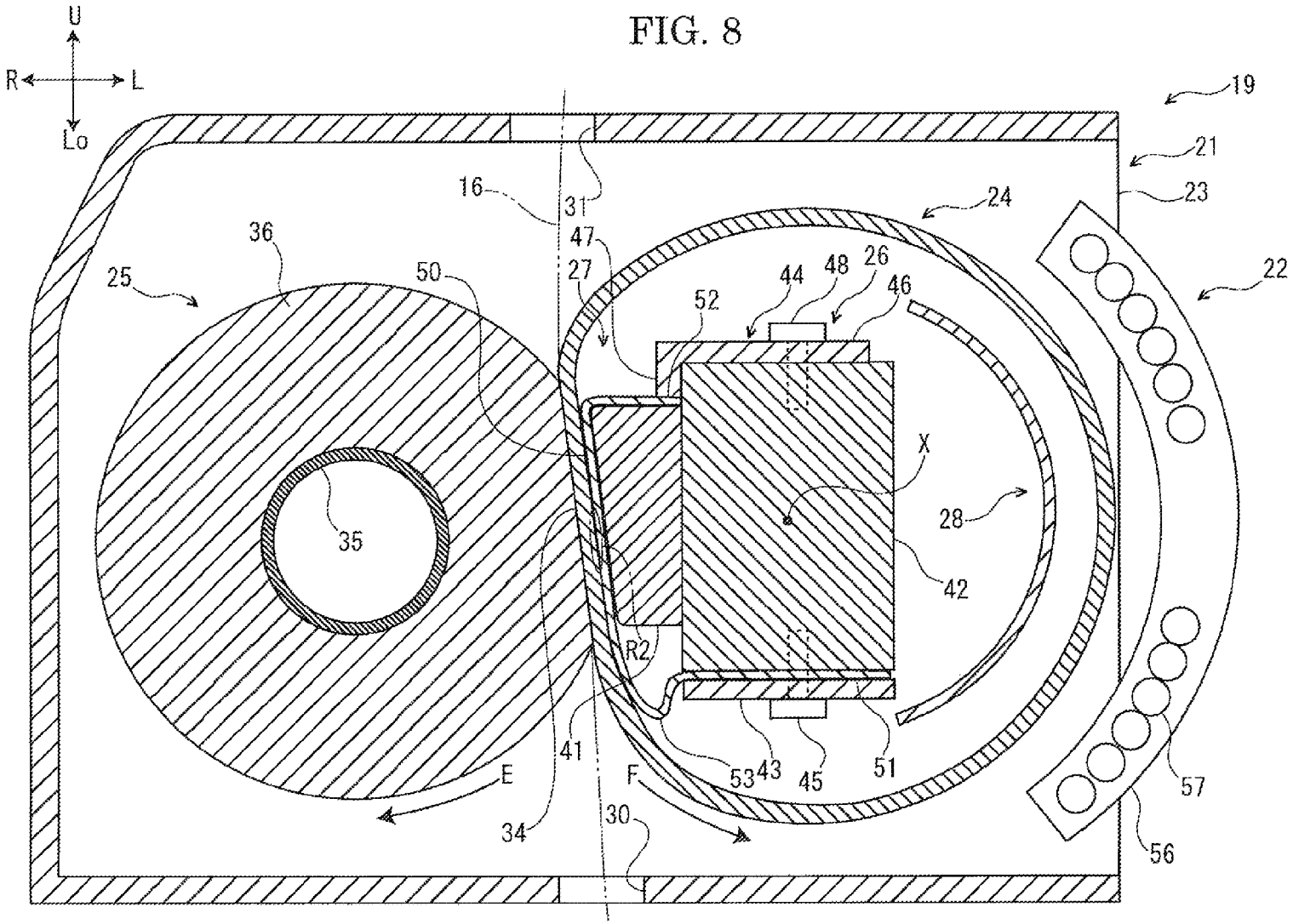
FIG. 8 is a sectional view showing a situation where the fixing belt and the pressuring roller are rotated reversely, in the fixing device of the color printer according to the first embodiment of the present disclosure.

Further, as shown in FIG. 8, when a toner image is not fixed to a sheet (e.g. during warm-up or during stand-by), the drive source 39 rotates the pressuring roller 25 reversely (see an arrow E in FIG. 8). When the pressuring roller 25 is rotated reversely as described above, the fixing belt 24 coming into pressure contact with the pressuring roller 25 is also rotated reversely (see an arrow F in FIG. 8). Hence, the fixing belt 24 pulls the sheet member 27 to the lower side (the upstream side in the conveying direction of sheets). According to this, the loose part 53 moves to the lower side (the upstream side in the conveying direction of sheets), so that the loose part 53 is formed in the area between the sliding contact part 50 and the upstream side fixed part 51. In this case, the lubricant held at the loose part 53 is supplied to an area between the fixing belt 24 and the sliding contact part 50 (see a portion R2 in FIG. 8). Consequently, it is possible to more effectively prevent the fixing belt 24 and the sliding contact part 50 from being worn away.

A case where the lengths of the supporting body 42 and the upstream side attachment plate 43 in the forward and backward directions (the direction of the rotation axis of the fixing belt 24) are longer than the length of the upstream side fixed part 51 in the forward and backward directions has been described in the present embodiment. Meanwhile, in other embodiments, the lengths of the supporting body 42 and the upstream side attachment plate 43 in the forward and backward directions (the direction of the rotation axis of the fixing belt 24) may be equal to the length of the upstream side fixed part 51 in the forward and backward directions. In this case, it is also possible to prevent the sheet member 27 from being wrinkled when the sheet member 27 is pulled to the upper side (the downstream side in the conveying direction of sheets).

A case where the lengths of the pressing body 41 and the bent part 47 in the forward and backward directions (the direction of the rotation axis of the fixing belt 24) are longer than the length of the downstream side fixed part 52 in the forward and backward directions has been described in the present embodiment. Meanwhile, in different embodiments, the lengths of the pressing body 41 and the bent part 47 in the forward and backward directions (the direction of the rotation axis of the fixing belt 24) may be equal to the length of the downstream side fixed part 52 in the forward and backward directions. In this case, it is also possible to prevent the sheet member 27 from being wrinkled when the sheet member 27 is pulled to the lower side (the upstream side in the conveying direction of sheets).

A case where, to the upper face (the downstream side face in the conveying direction of sheets) of the pressing body 41 and the lower edge part (the upstream side edge part in the conveying direction of sheets) of the bent part 47, the roughening treatment is applied has been described in the present embodiment. Meanwhile, in other embodiments, to one of the upper face (the downstream side face in the conveying direction of sheets) of the pressing body 41 and the lower edge part (the upstream side edge part in the conveying direction of sheets) of the bent part 47, the roughening treatment may be applied.

Figure 9:
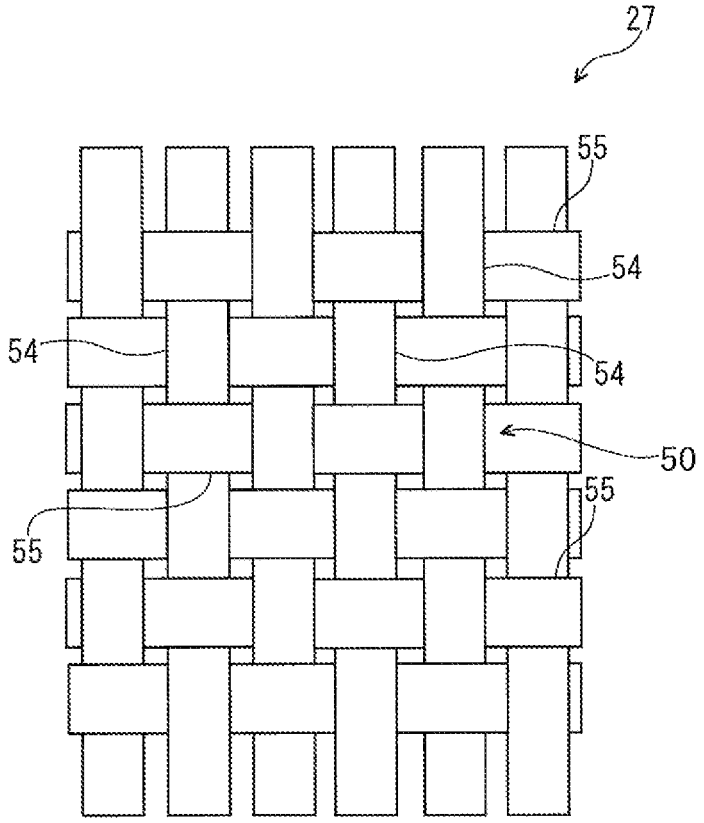
FIG. 9 is a side view showing a part of a sheet member, in the fixing device of the color printer according to another embodiment of the present disclosure.

A case where, by weaving the two woofs 55 while weaving one warp 54, the sheet member 27 is formed has been described in the present embodiment. Meanwhile, in other embodiments, proportions at which the warps 54 and the woofs 55 are woven may be changed by, for example, weaving the three or more woofs 55 while weaving one warp 54. Further, in other embodiments, as shown in FIG. 9, the sheet member 27 may be formed by so-called "plain weaving", and the warps 54 and the woofs 55 may be woven at the same proportion.

A case where the right face (outer face) of the pressing body 41 is linearly inclined to the right side (the side of the pressuring roller 25) toward the upper side (the downstream side in the conveying direction of sheets) has been described in the present embodiment. Meanwhile, in other embodiments, the right face (outer face) of the pressing body 41 may linearly extend along the conveying direction of sheets or the right face (outer face) of the pressing body 41 may be curved in an arc shape.

A case where the drive source 39 is connected to the pressuring roller 25 has been described in the present embodiment. However, in other embodiments, the drive source 39 may be connected to the fixing belt 24.

A case where the base material layer of the fixing belt 24 is made of metal has been described in the present embodiment. However, in other embodiments, the base material layer of the fixing belt 24 may be made of resin, such as polyimide.

A case where the IH coil 57 is used as the heat source is described in the present embodiment. However, in other embodiments, a heater such as a halogen heater and a ceramic heater may be used as the heat source.

In the embodiment, while the configuration of the disclosure is applied to the color printer 1, in other embodiments, the configuration of the disclosure may be applied to other image forming apparatus, such as a monochrome printer, a copying machine, a facsimile, a multifunction peripheral or the like.

Second Embodiment

Next, the second embodiment of the present disclosure will be described. In addition, components having the same configurations as those in the first embodiment will not be described.

Figure 10:
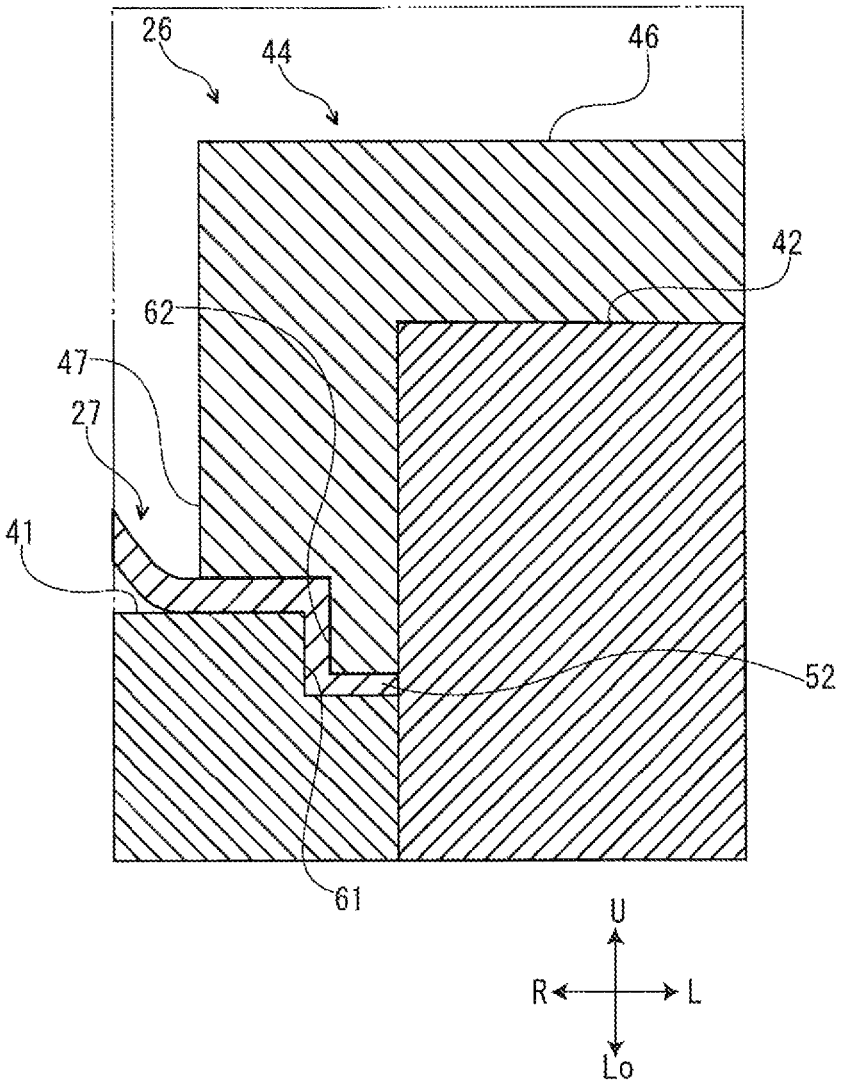
FIG. 10 is a sectional view showing a downstream side fixed part of a sheet member and its periphery, in a fixing device of a color printer according to a second embodiment of the present disclosure.

As shown in FIG. 10, in the upper face (the downstream side face in the conveying direction of sheets) of the pressing body 41, a recess part 61 (first engagement part) is arranged. At the lower edge part (the upstream side edge part in the conveying direction of sheets) of the bent part 47 of the downstream side attachment plate 44, a protruding part 62 (second engagement part) which engages with the recess part 61 is formed. The downstream side fixed part 52 of the sheet member 27 is sandwiched between the recess part 61 and the protruding part 62. By applying such a configuration, it is possible to enhance the strength to fix the downstream side fixed part 52.

A case where, at the upper face (the downstream side face in the conveying direction of sheets) of the pressing body 41, the recess part 61 is arranged, and, at the lower edge part (the upstream side edge part in the conveying direction of sheets) of the bent part 47 of the downstream side attachment plate 44, the protruding part 62 is arranged has been described in the present embodiment. Meanwhile, in other embodiments, at the upper face (the downstream side face in the conveying direction of sheets) of the pressing body 41, the protruding part 62 may be arranged, and, at the lower edge part (the upstream side edge part in the conveying direction of sheets) of the bent part 47 of the downstream side attachment plate 44, the recess part 61 may be arranged.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressuring member arranged rotatably and configured to come into pressure contact with the fixing belt so as to form a fixing nip;

a pressing member disposed inside of the fixing belt and configured to press the fixing belt to a side of the pressuring member; and a sheet member disposed between the fixing belt and the pressing member, wherein the sheet member includes:

a sliding contact part configured to come into sliding contact with the inner circumference face of the fixing belt;

an upstream side fixed part fixed to the pressing member at an upstream side of the sliding contact part in a conveying direction of a sheet;

a downstream side fixed part fixed to the pressing member at a downstream side of the sliding contact part in the conveying direction of the sheet; and a loose part formed in at least one of an area between the sliding contact part and the upstream side fixed part and an area between the sliding contact part and the downstream side fixed part, wherein the pressing member includes:

a pressing body configured to press the fixing belt to the side of the pressuring member;

a supporting body configured to support the pressing body; and an upstream side attachment plate disposed at an upstream side of the supporting body in the conveying direction of the sheet, wherein the upstream side fixed part is sandwiched between an upstream side face in the conveying direction of the sheet of the supporting body and a downstream side face in the conveying direction of the sheet of the upstream side attachment plate.

2. The fixing device according to claim 1, wherein lengths of the supporting body and the upstream side attachment plate in a direction of a rotation axis of the fixing belt are equal to or more than a length of the upstream side fixed part in the direction of the rotation axis of the fixing belt.

3. The fixing device according to claim 1, further comprising a drive source configured to rotate the fixing belt and the pressuring member normally and reversely, wherein the loose part is formed in the area between the sliding contact part and the downstream side fixed part when the drive source rotates the fixing belt and the pressuring member normally, the loose part is formed in the area between the sliding contact part and the upstream side fixed part when the drive source rotates the fixing belt and the pressuring member reversely.

4. The fixing device according to claim 1, further comprising an IH coil provided along an outer circumference of the fixing belt and configured to heat the fixing belt.

5. The fixing device according to claim 4, further comprising a guiding member disposed along an inner circumference face of the fixing belt and configured to generate heat by the magnetic field generated by the IH coil.

6. An image forming apparatus comprising the fixing device according to claim 1.

7. A fixing device comprising:

a fixing belt arranged rotatably;

a pressuring member arranged rotatably and configured to come into pressure contact with the fixing belt so as to form a fixing nip;

a pressing member disposed inside of the fixing belt and configured to press the fixing belt to a side of the pressuring member; and a sheet member disposed between the fixing belt and the pressing member, wherein the sheet member includes:

a sliding contact part configured to come into sliding contact with the inner circumference face of the fixing belt;

an upstream side fixed part fixed to the pressing member at an upstream side of the sliding contact part in a conveying direction of a sheet;

a downstream side fixed part fixed to the pressing member at a downstream side of the sliding contact part in the conveying direction of the sheet; and a loose part formed in at least one of an area between the sliding contact part and the upstream side fixed part and an area between the sliding contact part and the downstream side fixed part, wherein the pressing member includes:

a pressing body configured to press the fixing belt to the side of the pressuring member;

a supporting body configured to support the pressing body; and a downstream side attachment plate disposed at the downstream side of the supporting body in the conveying direction of the sheet, wherein the downstream side attachment plate includes:

a joined part configured to be joined to a downstream side face in the conveying direction of the sheet of the supporting body; and a bent part configured to be bent from the joined part to the upstream side of the conveying direction of the sheet, the downstream side fixed part is sandwiched between a downstream side face in the conveying direction of the sheet of the pressing body and an upstream side edge part in the conveying direction of the sheet of the bent part.

8. The fixing device according to claim 7, wherein a roughening treatment is applied to a portion of at least one of the downstream side face in the conveying direction of the sheet of the pressing body and the upstream side edge part in the conveying direction of the sheet of the bent part, the portion configured to come into contact with the downstream side fixed part.

9. The fixing device according to claim 7, wherein a first engagement part is arranged at the downstream side face in the conveying direction of the sheet of the pressing body, the first engagement part formed by one of a protruding part and a recess part, a second engagement part is arranged at the upstream side edge part in the conveying direction of the sheet of the bent part, the second engagement part formed by the other of the protruding part and the recess part and configured to engage with the first engagement part, wherein the downstream side fixed part is sandwiched between the first engagement part and the second engagement part.

10. The fixing device according to claim 7, wherein lengths of the pressing body and the bent part in a direction of a rotation axis of the fixing belt are equal to or more than a length of the downstream side fixed part in the direction of the rotation axis of the fixing belt.

11. A fixing device comprising:

a fixing belt arranged rotatably;

a pressuring member arranged rotatably and configured to come into pressure contact with the fixing belt so as to form a fixing nip;

a pressing member disposed inside of the fixing belt and configured to press the fixing belt to a side of the pressuring member; and a sheet member disposed between the fixing belt and the pressing member, wherein the sheet member includes:

a sliding contact part configured to come into sliding contact with the inner circumference face of the fixing belt;

an upstream side fixed part fixed to the pressing member at an upstream side of the sliding contact part in a conveying direction of a sheet;

a downstream side fixed part fixed to the pressing member at a downstream side of the sliding contact part in the conveying direction of the sheet; and a loose part formed in at least one of an area between the sliding contact part and the upstream side fixed part and an area between the sliding contact part and the downstream side fixed part, wherein the sheet member is composed of a warp extending along the conveying direction of the sheet at the sliding contact part and a woof extending along a direction crossing to the conveying direction of the sheet at the sliding contact part, a proportion of the warp being different from that of the woof, a total surface area of the warp is larger than that of the woof at a face of the fixing belt side of the sliding contact part.

* * * * *